US005353703A

United States Patent [19]

Rieker

[11] Patent Number: 5,353,703

[45] Date of Patent: Oct. 11, 1994

[54] MULTI-COLOR, SINGLE-PLATE PRINTING PRESS

[76] Inventor: Paul T. Rieker, P.O. Box 911, Murrieta, Calif. 92564

[21] Appl. No.: 952,689

[22] Filed: Sep. 29, 1992

[51] Int. Cl.[5] ..... B41F 5/16; B41F 5/22

[52] U.S. Cl. ..... 101/177

[58] Field of Search ..... 101/177, 181, 220, 175, 101/176, 179, 180, 182, 183, 184, 492

[56] References Cited

U.S. PATENT DOCUMENTS 4,011,812 3/1977 Lecha ..... 101/177
4,241,657 12/1980 Fujimori ..... 101/211
5,009,160 4/1991 Duarte ..... 101/422

*Primary Examiner*—J. Reed Fisher

*Attorney, Agent, or Firm*—Herbert M. Shapiro

[57] ABSTRACT

A printing unit system produces multi-color printing employing a single plate cylinder of a first diameter and a pair of blanket cylinders of a second diameter one-half that of the plate cylinder. The blanket cylinders impact associated impression cylinders, also of the second diameter, at the paper path and, in one embodiment, the two impression cylinders mate with a transfer cylinder. By using blanket and impression cylinders having portions with different diameter, multi-color, superimposed images are printed, two colors at a time. The images for the various colors are produced on a single film under computer control for creation of plates for mounting on the plate cylinder and are not adjustable with respect to one another.

10 Claims, 12 Drawing Sheets

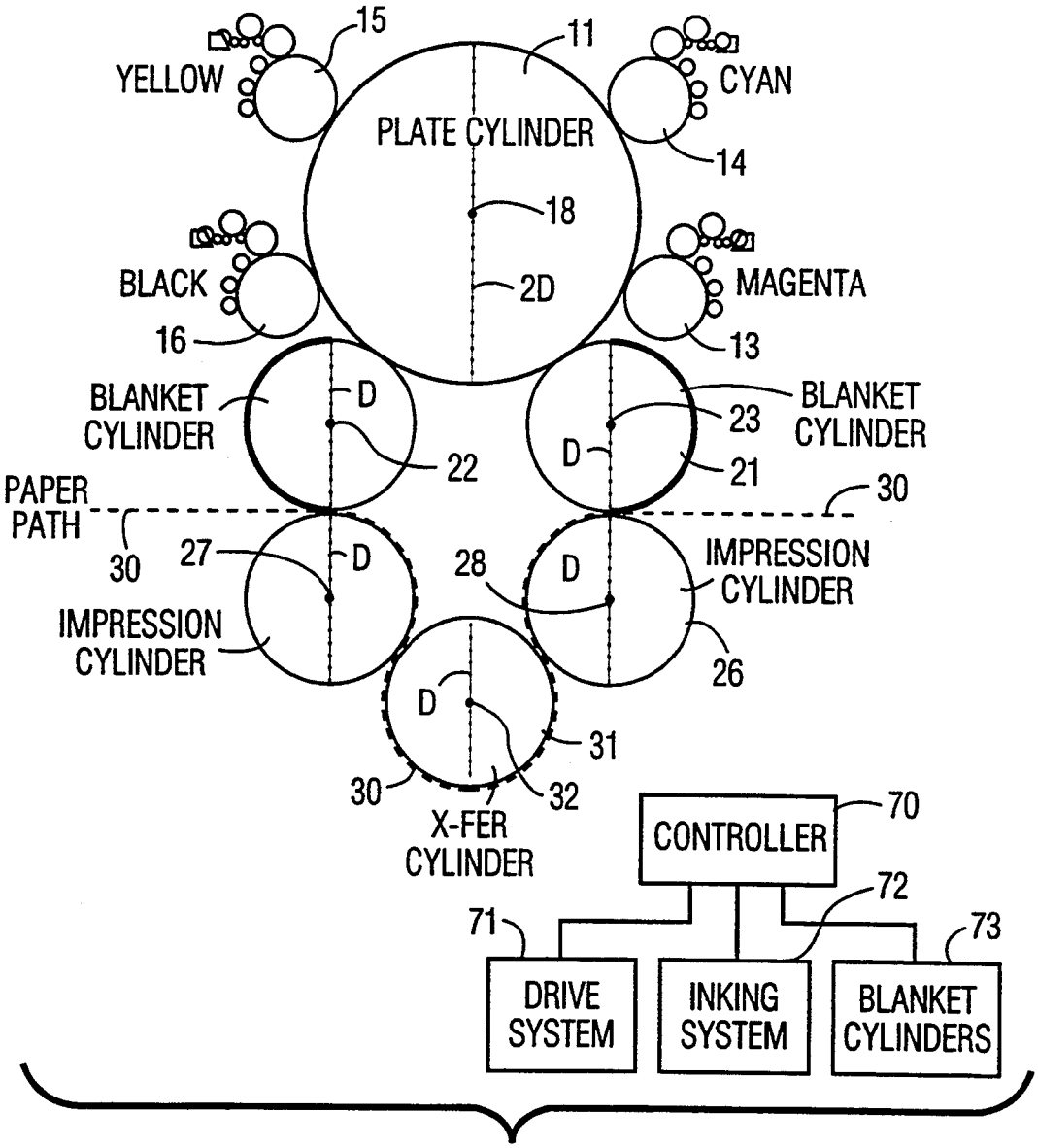
FIG. 1
FIG. 2
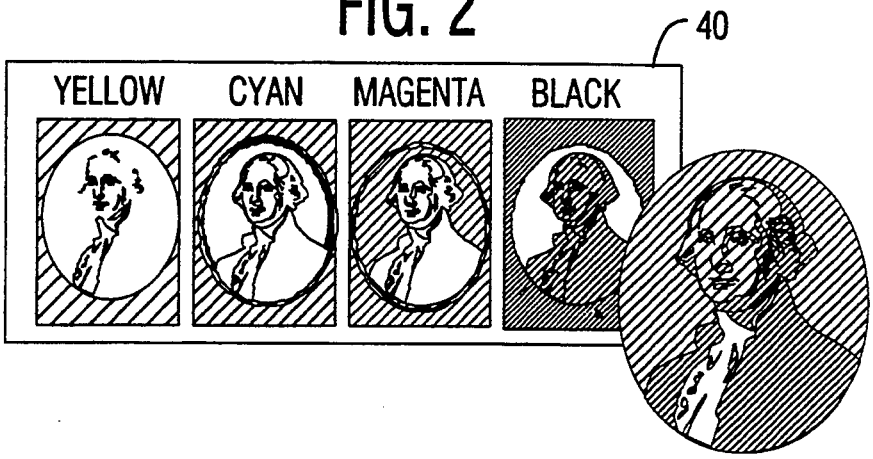

MULTI-COLOR, SINGLE-PLATE PRINTING PRESS

FIELD OF THE INVENTION

This invention relates to a printing press and, more particularly, to such a press for printing multi-color prints from a single printing plate.

BACKGROUND OF THE INVENTION

Prior art printing presses employ several cylinders which cooperate with one another to produce printed copy. Specifically, a "plate" cylinder is used to mount the information to be printed. A "blanket" cylinder rotates about an axis parallel to the plate cylinder axis such that the surface of the blanket cylinder contacts the surface of the plate cylinder in a manner to transfer the image from the plate cylinder. The transferred image is the inverse of the image on the plate cylinder as is well understood.

A third cylinder, the "impression" cylinder, similarly rotates about a third axis parallel to the axis of the blanket cylinder in a manner so that the surfaces of the blanket and impression cylinders contact one another. The image on the impression cylinder is again inverted to the original image for imprinting the final image on a medium(a sheet of paper) moving between the blanket and impression cylinders.

Such an arrangement becomes much more complicated when more than one color is necessary for the final copy. Traditionally, a complete such system is necessary for each color needed. Moreover, a separate ink supply tower is necessary along with control means for ensuring that the different color images are properly superimposed on one another.

There are known processes in which multi-color prints can be made using a single plate cylinder. One such press arrangement is described in U.S. Pat. No. 3,233,541 issued Feb. 8, 1966 to O. D. Johnson. The Johnson press employs a single plate cylinder on the surface of which a plurality of plates are mounted. The plates are mounted in sequence so that a sequence of images is transferred to a blanket cylinder for retransfer to an impression cylinder. If the plates are inked with different color inks, a succession of (inverted) color images is formed on the surface of the blanket cylinder. Such images would be transferred in succession to an impression cylinder (actually to sheets of paper moving between the blanket and impression cylinders) but it is not obvious as to how such images would be superimposed to make a multi-color print.

Instead the Johnson press is used in a manner such that one color is applied to an entire image and a second color is applied on top of the first color area to only a portion of the entire image. The image formed by the second layer of ink is split off and deposited on the blanket cylinder with the underlying first layer of ink remaining on the plate cylinder. The Johnson apparatus employs "form" rollers which have different diameters over different positions of their lengths. In portions of a roller where the diameter is small, only the second color is transferred from the plate cylinder to the blanket cylinder; where large, transfer of the underlying color occurs.

The Johnson apparatus is not usable for forming a multicolor image where a set of different color images are superimposed on one another.

Another printing apparatus which is also sheet fed, employs two plate cylinders and a single blanket cylinder to obtain double colors. Such a system is available from Townsend Industries of Iowa.

BRIEF DESCRIPTION OF ILLUSTRATIVE EMBODIMENTS OF THIS INVENTION

In accordance with one embodiment of this invention, plate cylinder is used with two blanket cylinders each having one-half the diameter or one-half the circumference of the plate cylinder as will become clear hereinafter. The apparatus, in one embodiment, also includes two impression cylinders each having a diameter of one-half that of the plate cylinder and contacting associated blanket cylinders at the paper path. An additional transfer cylinder, also has a diameter of one-half that of the plate cylinder. In another embodiment only a single impression cylinder is used and a transfer cylinder is not necessary.

A sequence of images to be inked, each with a different color, is formed, under computer control, on a single plate for mounting on the plate cylinder. The single image sequence is fixed and is not permissive of adjustment of one image with respect to another as is required of prior art systems where hand stripping is required.

The system of the present invention employs two images each one-half the circumference of the blanket or the impression cylinders or one quarter the circumference of the plate cylinder. Each blanket cylinder is recessed over one-half its circumference so as to contact the associated impression cylinder, at the paper path, only over the non-recessed portion of its circumference. Moreover, the ink "TACK" value is set so that the first color has a relatively high TACK value and the second has a relatively low TACK value (i.e., yellow pulls magenta) and this relationship is maintained with respect to the first and third of a four image (color) sequence and with respect to the second and fourth of the four images which are transferred to the first and second blanket cylinders respectively. In this manner, the two superimposed colors on each of the blanket cylinders are transferred simultaneously.

The use of two blanket cylinders with a single plate cylinder having twice the diameter thereof, the use of two impression cylinders, of like diameter, for impacting the blanket cylinders at the paper path, the relative TACK relationships of the inks employed, and the controlled production of a sequence of nonadjustable (color) images attached to a single plate cylinder are all considered significant departures from prior art thinking.

BRIEF DESCRIPTION OF THE DRAWING

FIG. 1 is a schematic side view of an offset printing press in accordance with the principles of this invention;

FIG. 2 is a schematic representation of a succession of images for the press of FIG. 1;

DETAILED DESCRIPTION OF AN ILLUSTRATIVE EMBODIMENT OF THIS INVENTION

Figure 3:
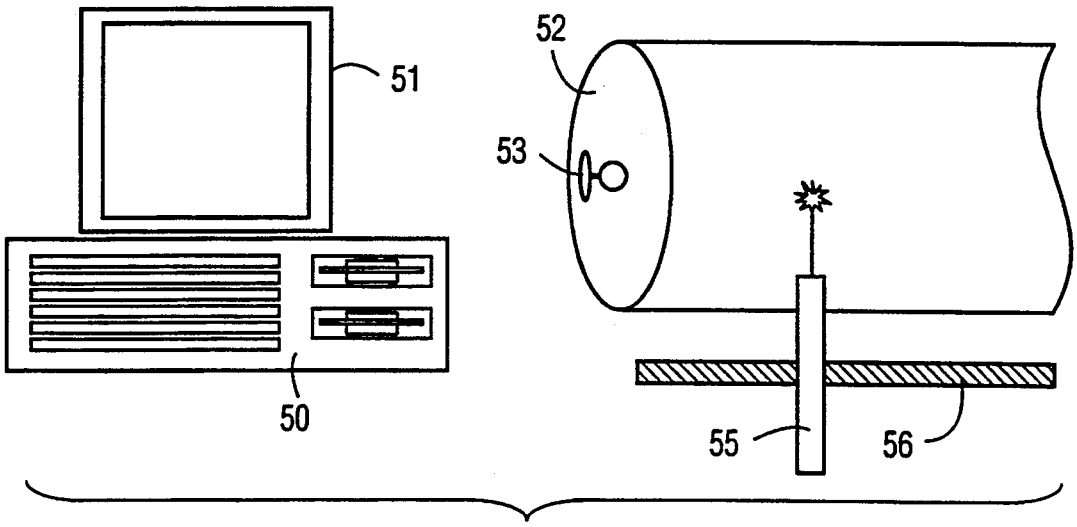
FIG. 3 is a schematic representation of a system for forming the succession of images of FIG. 2.

FIG. 1 is a schematic representation of an illustrative printing system 10 in accordance with the principles of this invention. The various components shown are cylinders extending into the paper as viewed and represented as circles.

The system includes a plate cylinder 11 shown as a circle having a diameter 2D. The plate cylinder operates with four inking roller sets 13, 14, 15, 16 for magenta, cyan, yellow and black respectively. Each set includes several rollers, only the largest of which is designated herein. Each set is entirely conventional except that the TACK values bear important relationships to one another which are discussed more fully below. The plate cylinder and the inking cylinders rotate controllably about axes which are parallel to one another and positioned into the paper as viewed. The axis for the plate cylinder is designated 18.

The plate cylinder cooperates with two blanket cylinders 20 and 21. The blanket cylinders also extend into the paper, as viewed, and rotate about axes 22 and 23, respectively, which are parallel to axis 18. Each blanket cylinder has a diameter D which is one-half the diameter (2D) of the plates cylinder but may also have a circumference equal to half that of the plate cylinder. In any case, the blanket cylinder has a geometry so that half its circumference corresponds to the associated image on the plate cylinder.

The blanket cylinders cooperate with impression cylinders 25 and 26. The impression cylinders, similarly, rotate about axis 27 and 28 and each has a diameter D equal to that of blanket cylinder 20 or 21. The paper path 30 extends between the blanket and impression cylinders.

The system, in one specific embodiment includes a transfer cylinder 31 which, similarly, rotates about axis 32 and also has a diameter D. The transfer cylinder is included in the paper path, in some instances when a greater distance between successive color impressions is required as will be explained more fully hereinafter.

FIG. 2 shows a set of images 40 of George Washington. The images are slightly different from one another and are intended, illustratively, to be printed in different colors as shown and superimposed on one another to produce a color image. Each image is one fourth the circumference of the plate cylinder and is produced to exact dimensions on a film to be attached to the plate cylinder. Thus, in one revolution of the plate cylinder, all four images, inked with the associated colors, pass a given reference point. Each blanket cylinder occupies one such reference point; each contacts the plate cylinder to transfer, successively, two of the four images. The system operates to transfer say the first and third images to blanket cylinder 20 and the second and fourth images to blanket cylinder 21 for a plate cylinder rotating counter clockwise as indicated by curved arrow 41 in FIG. 1.

First a system for forming the requisite sequence of images for attachment to the plate cylinder will be described. Thereafter, the operation of the various cylinders for the proper printing of those images in accordance with the principles of this invention will be described. Specifically, FIG. 3 shows a computer 50 with a color monitor 51. The figure also shows a drum 52 which spins, controllably, about axis 53. A laser 55, movable along a track 56, allows the laser beam to be directed at any position on the circumference of the drum as the latter spins. The computer senses the position of the drum, controls the position of the laser on track 56 and controls the on/off switching of the laser beam.

The image sequence is formed on a film of material which can be processed through conventional plating technology to accept ink selectively. Several conventional films are available and are in use at present in the printing field., One such film is a photolithographic film in which portions of the film are removed when exposed to a light image. An alternative image sequence technology is a silicon plate originally available from 3M Corporation.

Regardless of the film or plate employed, computer 50 of FIG. 3 includes software for controlling the placement of bit map image dots on the film. The computer controls the exact positions of the images on the plate cylinder thus eliminating technical stripping for the single plate cylinder four color press. The plate with the four images produced by the image setter is attached to the circumference of the plate cylinder.

Figure 4:
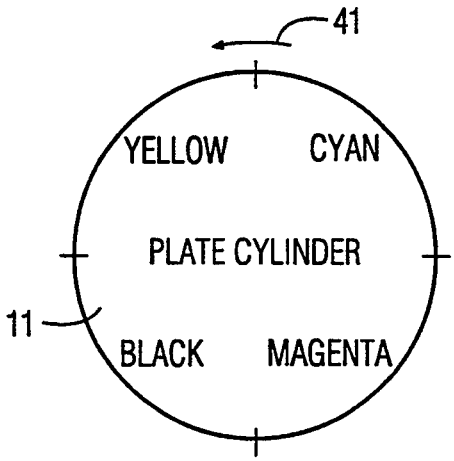
FIGS. 4 through 7 are schematic representations of the various cylinders in the system of FIG. 1.

FIG. 4 shows a schematic end view of plate cylinder 11 with an indication thereabout of the placement of the film and the portions thereof occupied by the different image-by color. Starting at the top of the cylinder, for clockwise rotation, the sequence of colors is cyan, magenta, black and yellow.

The objective of this bit map generation of images is to permit several images to be prepared for proper registration so that registration is achieved prior to the images being affixed to the respective printing device where each image may be printed with different colors of ink. Alternatively, or the same image may be printed in more than one position with the same color of ink, so that the color intensity or ink film thickness may be increased through over printing to a desired density.

This image placement system can be utilized by the Single Plate—Multiple Color Printing Press, Screen Printing (where all colors are imaged by computer control and printed on the same silk screen segregated by dividers in the screen frame thus making screen printing faster and more productive by straight line printing over rotary screen press devices), Pad Printer, or other printing devices where individual colors placement control may be established through computer control. This image placement may also be performed by a "Misomex" type film stepper.

As stated above, all colors (or images) may be positioned on a "straight line" either horizontally or vertically, where the spacing between the images are independently controlled so that an independent color may be adjusted so that proper registration is achieved on the printing device.

With regard to computer control, all of the computer color images on the computer disk are described in a bit map, that is "X and Y" coordinates which contain either a single bit, (black and white) or multiple bit (multiple levels of gray or multiple colors). The following description will be made with respect to the Single Plate-4 color printing press: As the bit map of 4 color images may be created by virtually any computer graphic program, placing these images in registration on a single plate for transfer through two printing blankets is unique. Consider that the four colors are process colors (these colors could be any colors), such as cyan, magenta, yellow, black. These colors must be placed on the single plate in position in a manner that permits the images to be transferred to the alternating high sides of the blanket cylinders. As the high side of the blanket cylinders may vary in thickness due to variance in blanket material thickness, the variance will require compensation so that the top of each image maintamayns registration, otherwise the; images will not overprint the sheet of paper in proper placement.

Consider that the four images are placed vertically one over the other, the spacing corresponding to ½ of the circumference of the blanket cylinder. To ensure the placement of the image, when transferred to the paper, slight up or down adjustment must be compensated for in the placement of the four images. This compensation must be available INDEPENDENTLY for each of the four images. There is NO HORIZONTAL ADJUSTMENT as in this application all images are required to be positioned in a STRAIGHT LINE.

The addition of placement information in the respective bit map is standard. For discussion purposes we will use a a bit map where the image is 20,000 counts high by 50,000 counts wide for each of CMYK images where K stands for black or neutral. Also for discussion purposes, the plate cylinder has a circumference of 100,000 counts around the cylinder.

The Cyan image is placed at count #1, Magenta image placed at count #25,000, Yellow at count #50,000 and Black placed at count #75,000, this will provide optimum placement of these images, in theory. In reality, the blanket cylinders may not be machined perfectly for image placement and may not be at exact angles to each other for optimum image placement. Additionally, the blanket material will vary in thickness. Compensations for these inaccuracies must be made individually for each image. Measurement of the color images as the paper is delivered from the press will determine the amount of compensation, either up or down as required. We will start with the Cyan image as our standard and adjust all other images to it. Consider the case where the Yellow image is high with respect to the Cyan, the Black image is low and the Magenta image is placed exactly in position. Then the compensation of the images are as follows:

Cyan standard where placement is established—No adjustment

Yellow image is high by X measurement—lower Yellow by adding X+50,000

Magenta image is accurately placed—No adjustment

Black image is low by X—Adjust Black higher by subtracting 75,000 -X.

As all bit maps are described in horizontal and vertical "coordinates," these compensations are done by adding the, proper respective spacing to the horizontal numbers. For example, the first string of the 50,000 wide may (for a single bit) look as follows:

| | Original Position | | | After Adjustment | | |
|---|---|---|---|---|---|---|
| Black | Horizontal | Vertical | Bit | Horizontal | Vertical | Bit |
| | 1 | 1 | off | 75,001 | 1 | off |
| | 2 | 1 | off | 75,002 | 1 | off |
| | 3 | 1 | on | 75,003 | 1 | on |
| | 4 | 1 | on | 75,004 | 1 | on |

and so on. The second string of the bit map may look like this:

| | Original Position | | | After Adjustment | | |
|---|---|---|---|---|---|---|
| Black | Horizontal | Vertical | Bit | Horizontal | Vertical | Bit |
| | 1 | 2 | on | 75,001 | 2 | on |
| | 2 | 2 | off | 75,002 | 2 | off |
| | 3 | 2 | off | 75,003 | 2 | off |
| | 4 | 2 | on | 75,004 | 2 | on |

and so on. The placement compensation is applied to only the horizontal count.

This placement control may be achieved through various software and hardware implementations as is well understood.

The film imaging system of FIG. 3 responds to imaging data available from commercial raster image processors in a conventional manner. Resolutions of 3000 dots per inch or higher are presently achievable. Dots of such small size are more than can be utilized presently for type or simple graphics work. But clusters of such small dots can be used to compose "half-tones" promoting extremely smooth gradations through the gray scales for the purpose of creating blended colors with fine control.

The film imaging system operates to mount the film/plate on a spinning drum (52 or FIG. 3) so that as the drum spins, the laser which is imaging perpendicularly with respect to the drum axis can be drawn along the length of the drum. In his manner, the first quarter of the plate is imaged with an initial pixel string and associated data for that quarter plate (first image). The second image is similarly formed with the associated data and the same pixel string. The third and fourth images are similarly formed, with the associated data but the same pixel string. This operation ensures accurate placement of the images.

Figure 5:
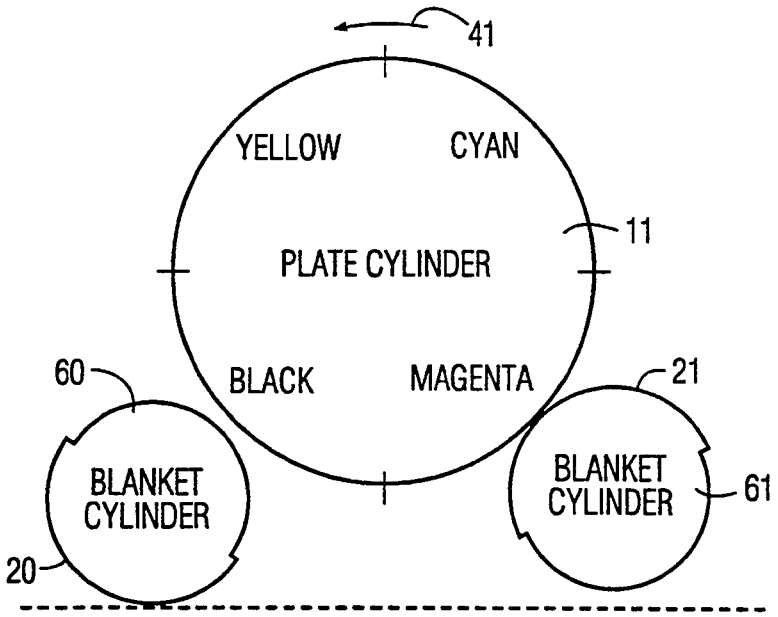

FIGS. 4 and 5 show end views of the plate cylinder 1 and the plate and blanket cylinders 11, 20, and 21 of FIG. 1 but in greater detail. The blanket cylinders can be seen to include recesses 60 and 61 respectively. The blanket cylinders are identical where the recesses occupy one-half of the cylinder circumference, each being thought of as being formed by two half cylinders of different diameters attached at their faces. But the two blanket cylinders rotate out of phase with one another. Thus, when cylinder 20 is not in contact with the plate cylinder, having its recess 60 facing the plate cylinder, cylinder 21 is in contact with the plate cylinder and vice versa. Because each blanket cylinder is one-half the diameter of the plate cylinder, and because the recesses in the blanket cylinders face the plate cylinder out of phase with one another, each blanket cylinder contacts the plate cylinder at every other one of the four images. In this manner, the first and third images are transferred to blanket cylinder 20 and the second and fourth images are: transferred to blanket cylinder 21—on top of one another.

The blanket cylinders contact impression cylinders 25 and 26 respectively. The impression cylinders have constant diameter (without recesses) equal to that of the blanket cylinders but are cammed to contact the associated blanket cylinder during every other rotation. A sheet of paper is introduced to the paper path, indicated by line 30 in FIGS. 1 and 6, between the blanket and impression cylinders during every other rotation of the blanket cylinder (21). The paper path is shown also by a dashed line at 65 in FIG. 6 to indicate that for drying purposes the paper sheet may proceed along a path around a transfer cylinder 70 as shown in FIG. 7.

A single large diameter (2D) impression cylinder can be used instead of two smaller diameter impression cylinders without a transfer cylinder as is now explained more fully.

Figure 8:
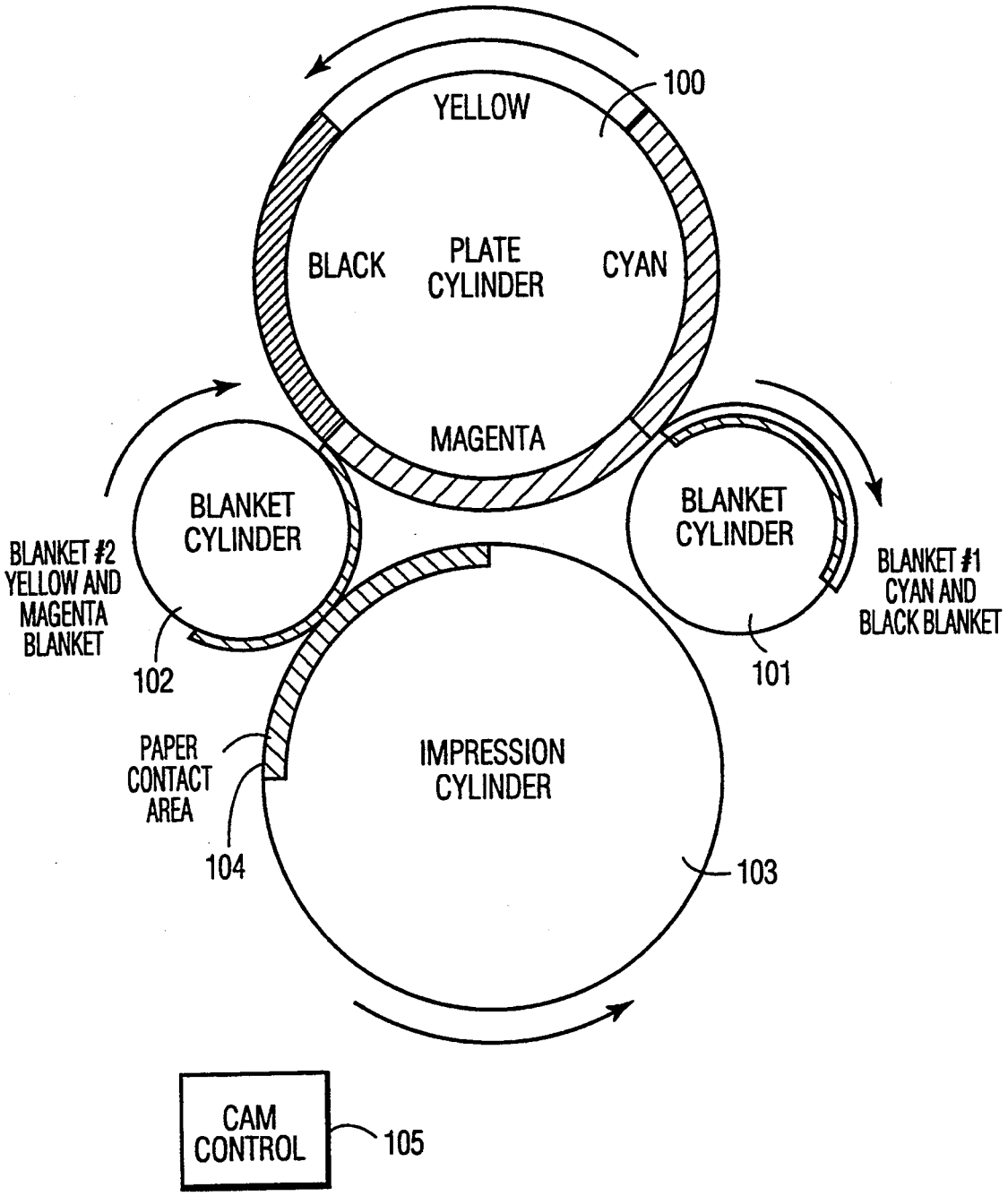
FIGS. 8 through 16 are schematic representations of successions of cylinder orientations during operation in accordance with the principles of this invention.

FIGS. 8 through 16 are schematic end views of the various cylinder orientations herein during successive stages of operation of the press in accordance with the principles of this invention, in an embodiment using a single impression cylinder. Specifically, FIG. 8 shows a plate cylinder 100, first and second blanket cylinders 101 and 102, respectively, and a single impression cylinder 103. The plate cylinder has, illustratively, different color images, each occupying one-fourth the circumference of the plate cylinder. Each blanket cylinder is configured to contact the plate cylinder only over one-half its circumference but has a circumference equal to one-half that of the plate cylinder. Therefore, contact between a blanket cylinder and the plate cylinder occurs during every other one fourth revolution. Since the blanket cylinders contact the plate cylinder out of phase with one another, cylinder 101 contacts the plate cylinder in registry with the cyan and black quadrants whereas cylinder 102 contacts the plate cylinder in registry with the yellow and magenta quadrants. In order to avoid printing one color image before the requisite superimposed image is in place on a blanket cylinder, the impression cylinder is arranged to contact a blanket cylinder over only one fourth of its surface (for single impression cylinder embodiments). Such a paper contact area is designated 104 in FIG. 8.

FIGS. 9 through 16 show the succession of cylinder orientations and positions for printing four color images employing an illustrative one impression cylinder embodiment of this invention, Operation starts from the situation illustrated in FIG. 8. The various cylinders are rotating as indicated by the associated curved arrows, the plate cylinder 100 rotating counterclockwise as indicated by curved arrow 105 and the cyan image and the magenta image have been transferred to blanket cylinders 101 and 102 respectively, as indicated in FIG. 8. The low sides of the blanket cylinders are now facing the plate cylinder and do not receive Images.

Figure 9:
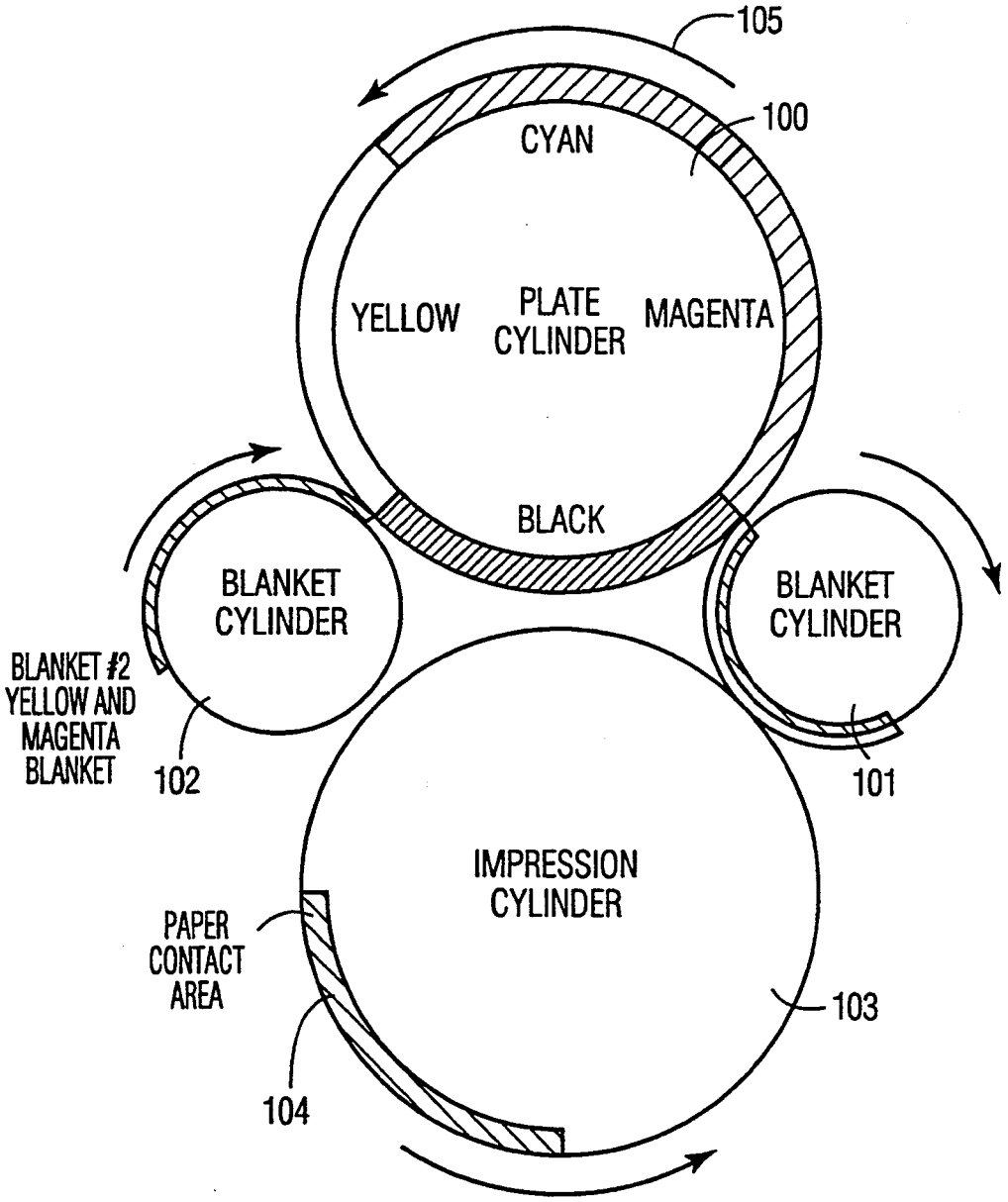

As the plate cylinder continues to rotate, the leading edge of the black image does not contact blanket cylinder 102 and the leading edge of the magenta image does not contact blanket cylinder 101. As the plate cylinder continues to rotate, the leading edge of the yellow and black images contact blanket cylinders 102 and 101 to deposit these images over the cyan and magenta already on blanket cylinders 102 and 101 respectively. FIG. 9 shows the juncture in the operation where the leading edges of the yellow and black images are in position to begin transfer to the respective blanket cylinders and magenta and cyan images are already tansferred. The impression cylinder, although rotating, is adjusted (conveniently by a cam) to contact the blanket cylinders 101 and 102 in succession over a surface contact area of one fourth of the circumference of the impression; cylinder, a length equal to the length of an image on the plate cylinder. The paper contact area is designated 104. The situation depicted in FIG. 9 is that magenta and cyan images already have been transferred to cylinders 102 and 101 respectively, yellow and black images are about to be deposited on top of the magenta and cyan images respectively, no contact has occurred with the impression cylinder and no sheets of paper have, as yet, been fed into the paper path.

Figure 10:
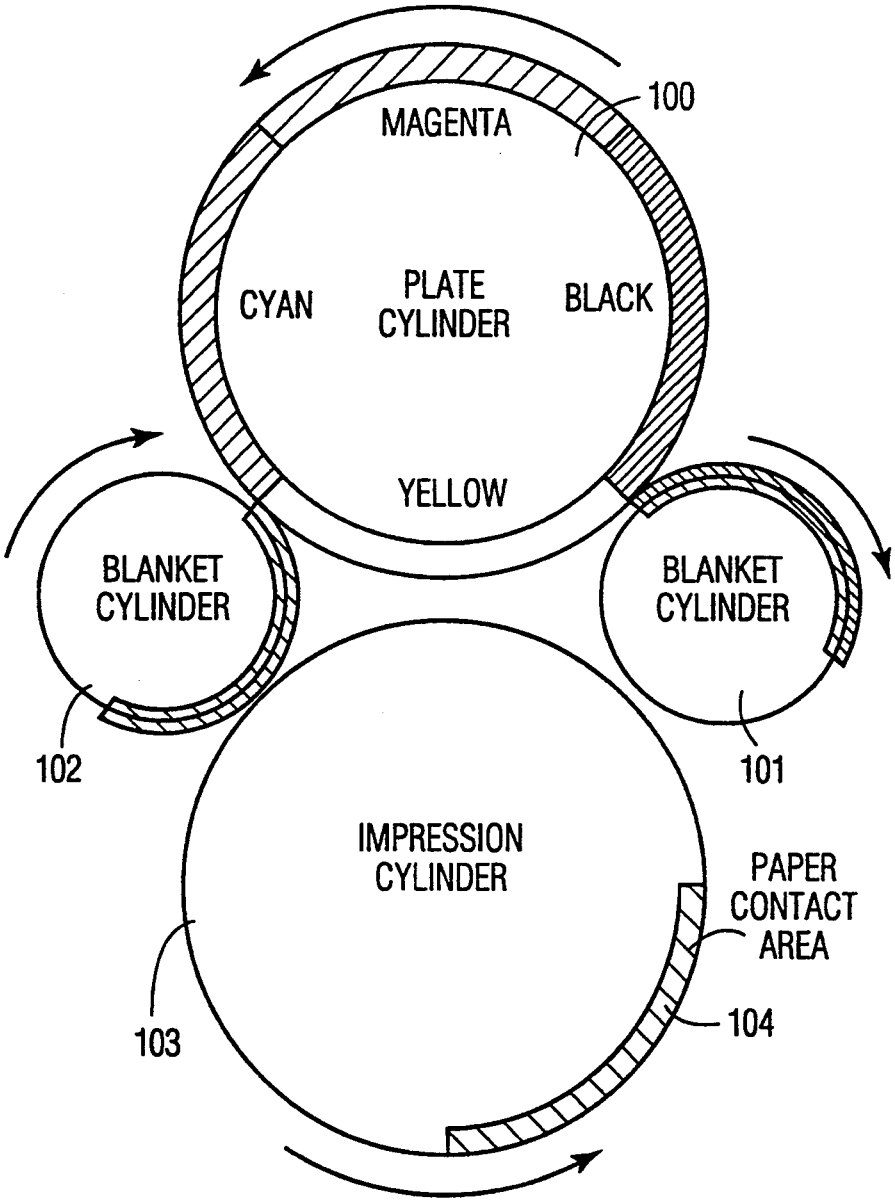

FIG. 10 depicts the situation where the yellow and black images are already transferred and the paper contact area 104 of the impression cylinder is approaching blanket cylinder 101. Still no sheets of paper have as yet been fed into the paper path.

Figure 11:
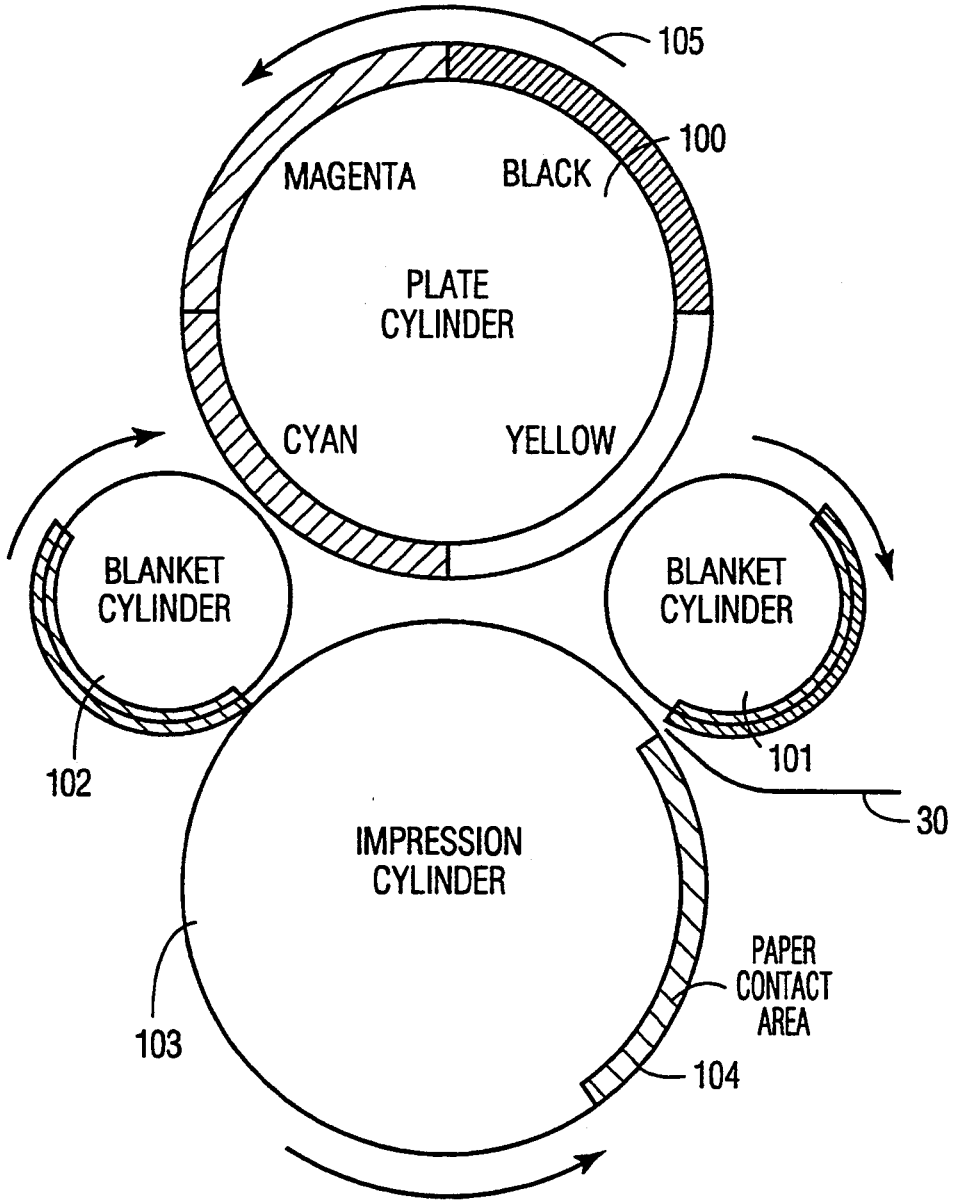

FIG. 11 depicts the next phase of the operation where paper contact area 104 is about to contact blanket cylinder 101. A sheet of paper is introduced into paper path 30 to be properly positioned between contact area 104 and the blanket cylinder. The transfer of the superimposed black and cyan images to the sheet of paper now commences.

Figure 12:
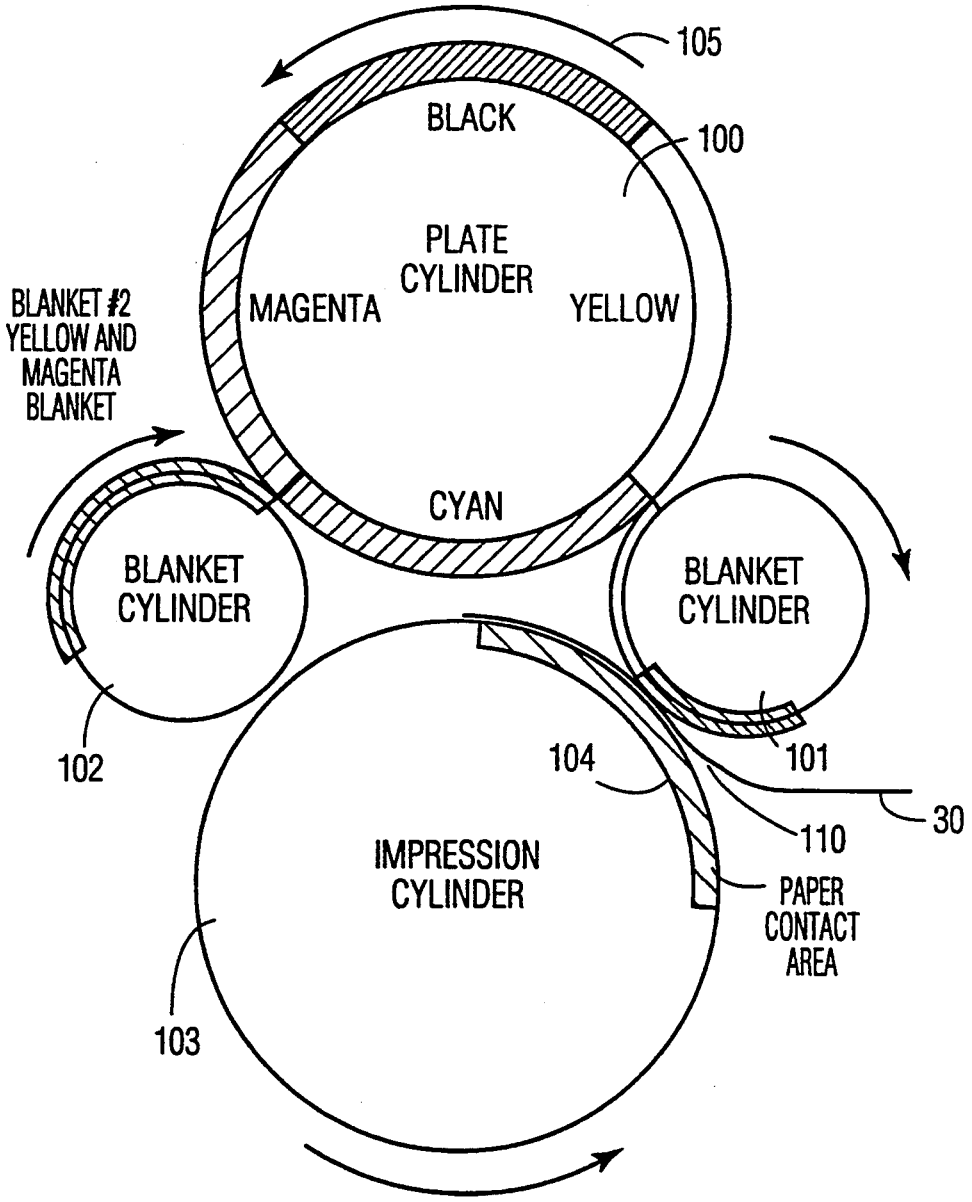

FIG. 12 depicts the situation where one-half of the superimposed black and cyan images have been transferred to the sheet of paper and paper contact area 104 starts to move toward blanket cylinder 102 to be in a position to transfer the superimposed yellow and magenta images onto the cyan and black images already on the sheet of paper.

Figure 13:
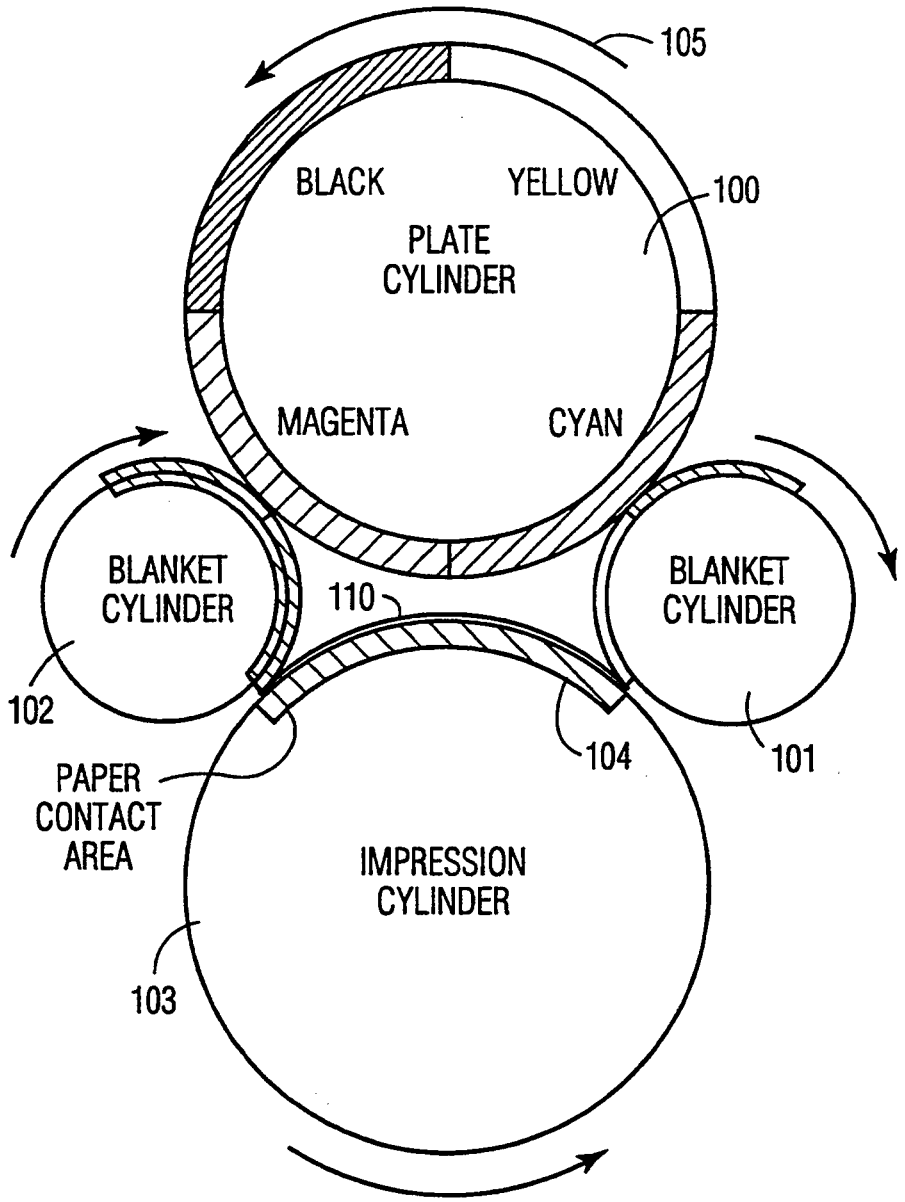

But note that a second magenta image is about to be transferred to blanket cylinder 102 before the superimposed yellow and magenta images can be transferred to the sheet of paper and a cyan image is about to be transferred to cylinder 101. The latter is acceptable. The former is not. But it is avoided by initiating the inking process with black and paper contact area 104 of the impression cylinder is positioned between the two blanket cylinders. Thus, the yellow image is transferred to cylinder 102 after the cyan image has been transferred to cylinder 101 and simultaneously with the transfer of the black image to cylinder 101. Thus, the black image, pulling the cyan image with it, is transferred to a sheet of paper and the sheet of paper is moved to cylinder 102. When the sheet arrives at cylinder 102, the magenta image is just being deposited on cylinder 102 as paper contact area 104 moves into position to transfer the magenta image, now pulling the yellow image. FIG. 13 depicts the situation where a sheet of paper 110 arrives at blanket cylinder 102. It can be seen from the figure that half the cyan and magenta images have been transferred.

Figure 14:
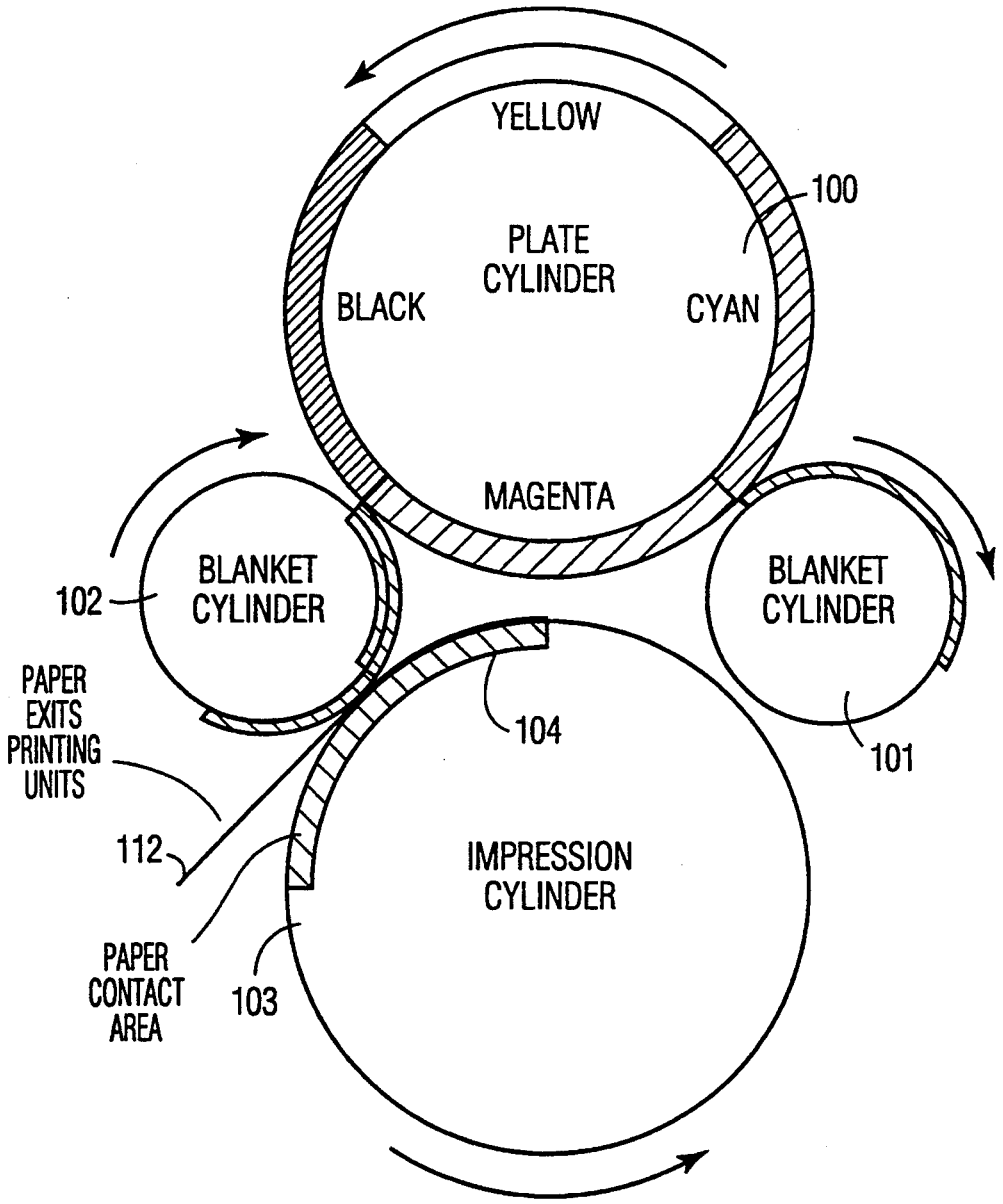

Transfer of the four color images is now complete. Once the press cycle commences, a complete cycle of operation entails one rotation of the plate cylinder, two rotations of the blanket cylinders and one rotation of the impression cylinder. One sheet of paper is fed in during each cycle, FIG. 14 depicts the situation where the complete black and yellow images have been transferred to blanket cylinders 101 and 102 and the first sheet of paper carrying the four color images exit the printing unit at 112.

Figure 15:
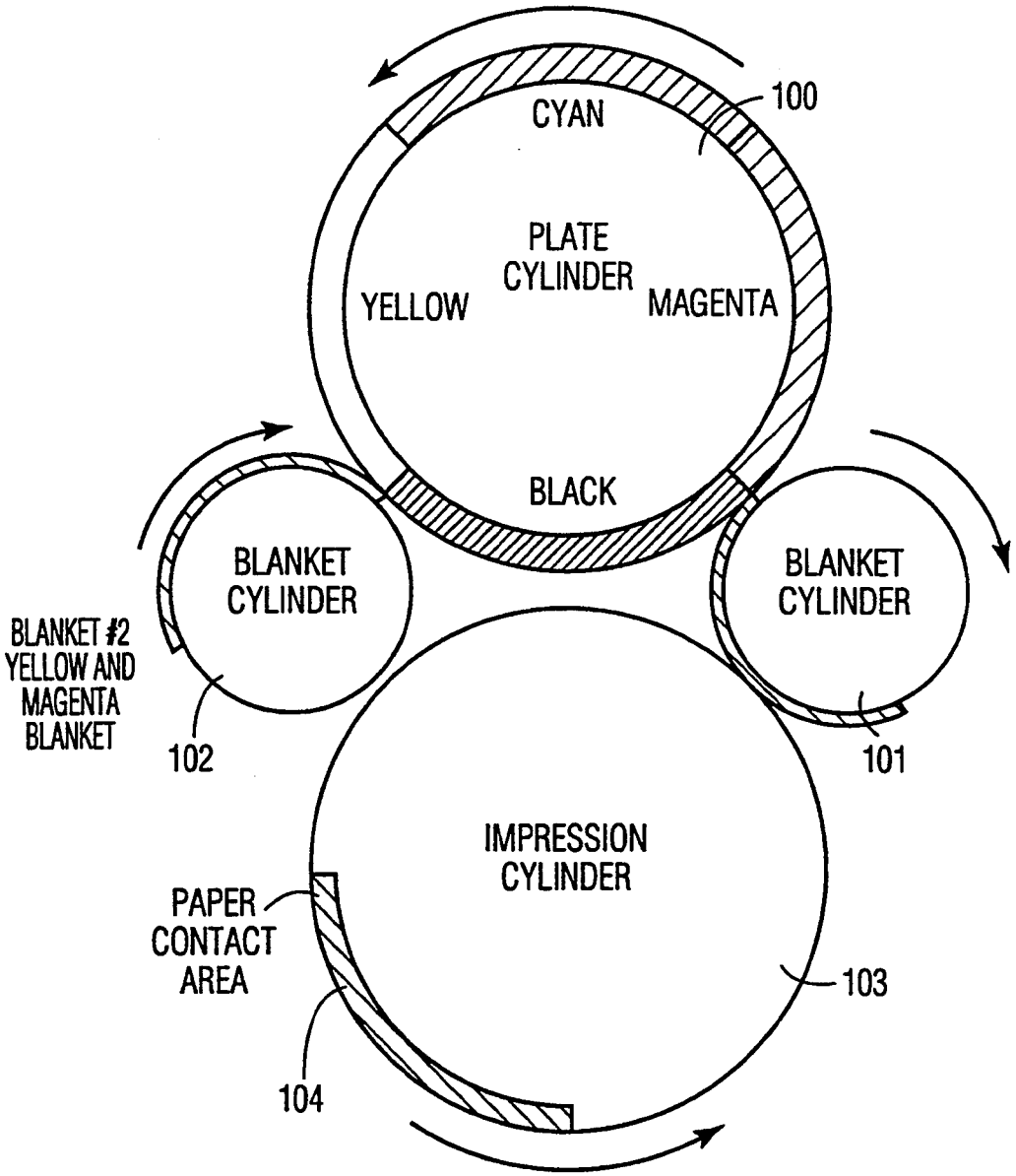
Figure 16:
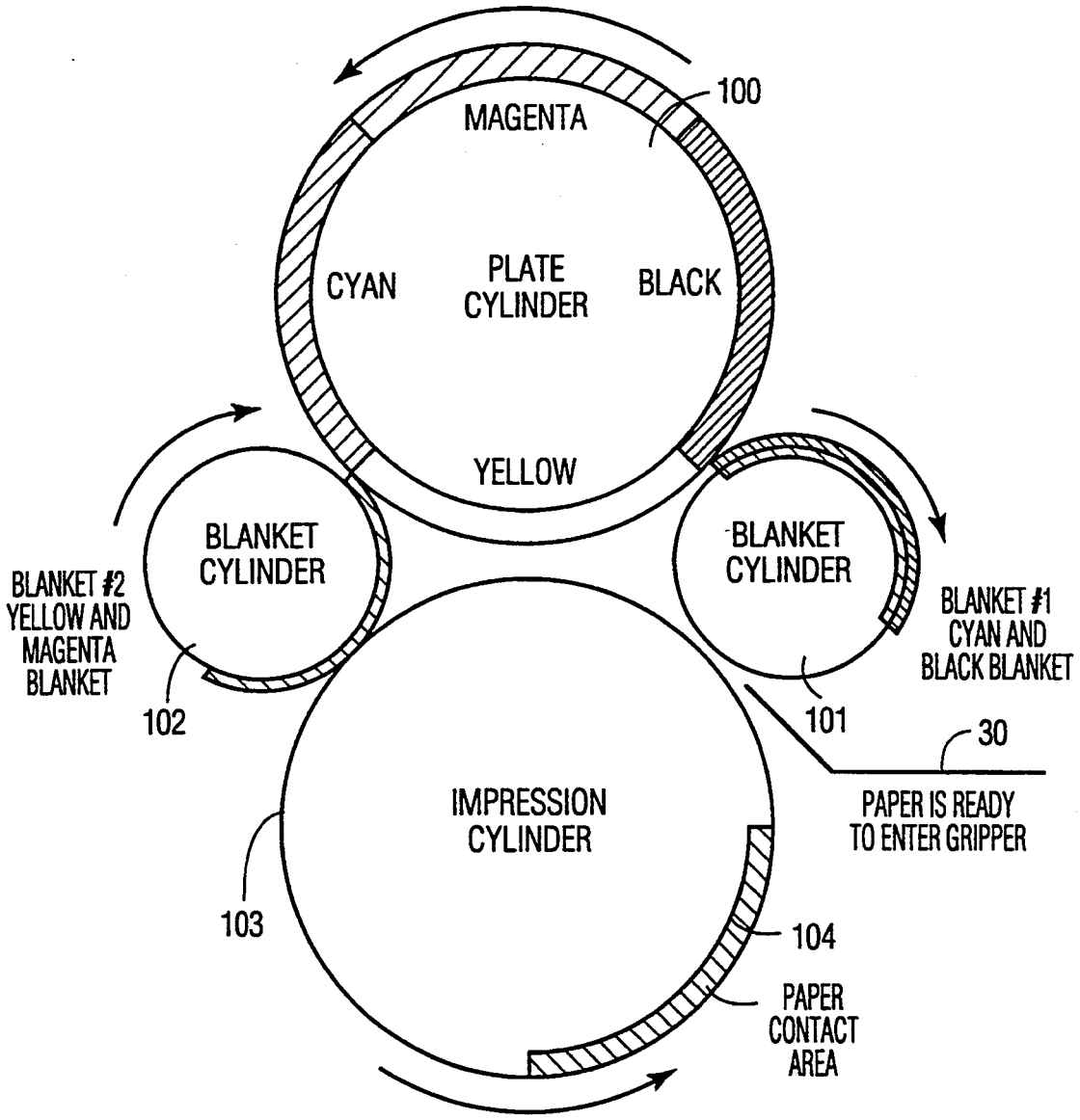

FIG. 15 depicts the next phase of a cycle of operation where a black image again is ready to be formed on blanket cylinder 101 and a yellow image is positioned for transfer to blanket cylinder 102. A second sheet of paper is being readied along paper path 30 for proper position between paper contact area 104 and blanket cylinder 101 for transfer of the second superimposed cyan and black images.

The impression cylinder's position into and out of contact with the respective blanket cylinders is conveniently adjusted by a familiar cam arrangement represented by block 105 in FIG. 8. Alternatively, the paper contact area of the impression cylinder can be made high.

A similar cam arrangement is employed to adjust the contact of impression cylinders 25 and 26 with respect to blanket cylinders 20 and 21 respectively for embodiments employing two impression cylinders as shown in FIG. 1. Such a cam arrangement is considered included within drive system block 71 or FIG. 1. The cam operates to provide contact between the impression cylinder (or cylinders) and the associated blanket cylinder only during alternative rotations of the blanket cylinder.

Once a printing operation commences, a paper sheet is introduced into the paper path every other rotation of the blanket cylinders at a time to coincide with the proper position of the superimposed images for printing. The paper feed is controlled also by controller 70.

Rollers 13, 14, 15, and 16 of FIG. 1 are called "form" rollers, one being included in each inking unit. The form roller is the roller which actually applies the ink to the plate image. The form roller has the same circumference as the width of a printed image. Each roller applies ink to the image of the associated quadrant of the plate cylinder circumference. A cylinder (i.e. cam) follower is utilized to adjust the position of the inking system (i.e., form rollers) to the plate cylinder at the appropriate time. The color image which is associated with the respective inking station is applied with ink as the cam follower permits the respective form roller to come into contact with the plate cylinder.

The ink "TACK" or "stickiness" of the ink, can be important in the present system and the proper selection of "TACK" value for the inks is thus also important, Specifically the "TACK" values of the inks applied one on top of the other on the respective blanket is such that when the top layer of ink is impressed on paper, that layer sticks to the paper and "pulls" the under lying layer along with it. In the illustrative system, suitable "TACK" values for magenta, cyan, yellow, and black inks are 18, 16, 14, 12.

The ink train temperature also is controlled to ensure proper transfer of the ink when applied. The simplicity of the system lends itself to water or air cooling from within the various ink rollers or cylinders to this end. This is particularly useful for images formed on silicon plates by the 3M process noted above because cooling is relatively critical with such a system.

The control of the speed of rotation of the various, cylinders and the movement of the various cylinders into and out of contact with one another, the application of the ink, and the paper feed movement are controlled by a controller represented by block 70 of FIG. 1 along with a motor drive system represented by block 71, and an ink system control represented by block 72.

The use of a single plate cylinder in accordance with the principles of this invention substantially reduces "make ready" time. Further, one proper initial adjustment of the film on the plate cylinder establishes the vertical relationship of the images and will not later require "press" adjustment. Thus, such a system not only is relatively inexpensive but is quicker, simple and more accurate.

Figure 6:
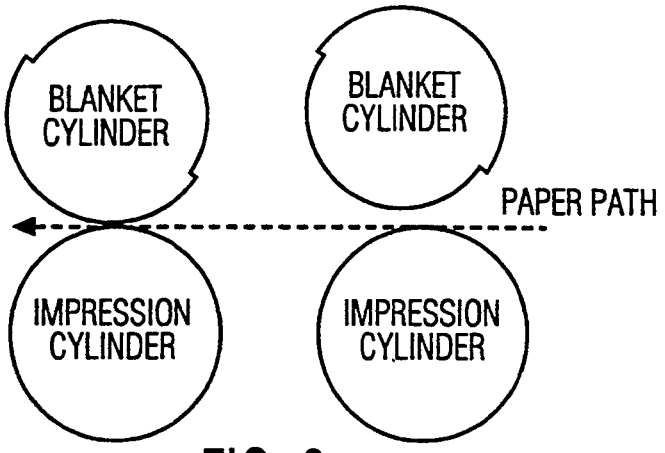
Figure 7:
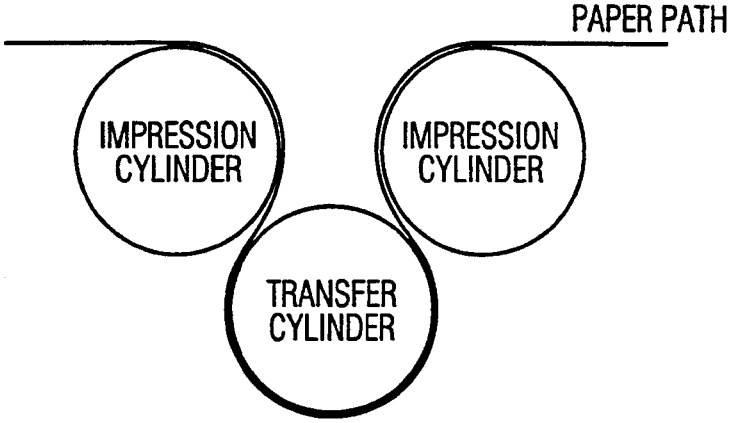

The blanket cylinders of FIGS. 1, 5 and 6 are described as having recesses so that contact with adjacent plate and impression cylinders is achieved over only a portion of the respective surface areas therof. The same result can be achieved by including the rubber blanket, characteristic of blanket cylinders, over only a portion of the cylinder thus elevating the "covered" portion with respect to the uncovered (i.e., recessed) portion.

What is claimed is:

1. A printing unit comprising a single plate cylinder of a first diameter and first and second blanket cylinders of a second diameter equal to one-half of said first diameter, said plate cylinder including means for connecting to the surface thereof a plate including a sequence of first, second, third and fourth images each of said images being in a fixed position with respect to one another and occupying one-quarter of the circumference of said plate cylinder, each of said blanket cylinders having a recessed surface over half of it's circumference, said printing unit including means for rotating synchronously said plate cylinder and said blanket cylinders about respective axes such that said first blanket cylinder contacts said plate cylinder only at the position of said first and third images and said second blanket cylinder contacts said plate cylinder only at the positions of said second and fourth images, said printing unit also including first and second impression cylinders juxtaposed and associated, respectively, with said first and second blanket cylinders and having a paper path therebetween, said impression cylinders also having said second diameter, said printing unit also including first, second, third and fourth inking means and means for applying ink from said inking means to respective ones of said images controllably.

2. A printing unit as set forth in claim 1 wherein said first and third inking means includes ink with tack values of a relatively high and a relatively low value respectively such that superimposed first and third images comprising first and third layers of ink from said first and third inking means respectively can be transferred simultaneously from said first blanket cylinder to said paper path at said associated first impression cylinder.

3. A printing unit as set forth in claim 2 wherein said second and fourth inking means includes ink with tack value of a relatively high and a relatively low value respectively such that superimposed second and fourth images comprising first and second layers of ink from said second and fourth inking means respectively can be transferred simultaneously from said second blanket cylinder to said associated second impression cylinder.

4. A printing unit as set forth in claim 3 wherein said phase comprises silicon.

5. A printing unit, said unit including a single plate cylinder having a circumference and being rotatable about a first axis, said circumference having first, second, third and fourth image areas defined thereabout, said unit also including first and second blanket cylinders, each of said blanket cylinders having defined thereon an image contact area, said blanket cylinders being juxtaposed with said plate cylinder and rotatable about respective axes such that the image contact area of said first blanket cylinder contacts only said first and third image areas of said plate cylinder and said image contact area of said second blanket cylinder contacts only said second and fourth image areas of said plate cylinder, said unit also including first and second impression cylinders juxtaposed and associated, respectively, with said first and second blanket cylinders and having a paper path therebetween, said unit also including first, second, third and fourth inking means and means for applying ink from said inking means to respective ones of said four images controllably.

6. A printing unit as set forth in claim 5 wherein said plate cylinder has a first diameter and each of said blanket cylinders has a diameter equal to half that of said plate cylinder.

7. A printing unit as set forth in claim 5 wherein said plate cylinder has a first circumference and each of said blanket cylinders has a circumference equal to half that of said plate cylinder and an image contact area equal to one-fourth of the circumference of said plate cylinder.

8. A printing unit as set forth in claim 7 wherein each impression cylinder has a first circumference and a paper contact area equal to one-fourth of it's circumference, each said impression cylinder being rotatable about an axis such that said paper contact area contacts said image contact areas of said blanket cylinders sequentially.

9. A printing unit as set forth in claim 7 also including a transfer cylinder having a circumference equal to that of said second impression cylinder and being rotatable about an axis to contact both of said first and second impression cylinders simultaneously.

10. A printing unit as set forth in claim 5, said unit including a single plate for attachment to the circumference of said plate cylinder, said plate having formed thereon, first, second, third, and fourth image in fixed positions corresponding to said first, second, third, and fourth image areas.

* * * * *